US009538819B1

(12) United States Patent
Hayes et al.

(10) Patent No.: US 9,538,819 B1
(45) Date of Patent: Jan. 10, 2017

(54) UMBRELLA HAVING AN EXPANDABLE CANOPY

(71) Applicants: Candice Hayes, Cordova, TN (US); Ruthie Mason, Cordova, TN (US)

(72) Inventors: Candice Hayes, Cordova, TN (US); Ruthie Mason, Cordova, TN (US)

( * ) Notice: Subject to any disclaimer, the term of this patent is extended or adjusted under 35 U.S.C. 154(b) by 0 days.

(21) Appl. No.: 15/132,407

(22) Filed: Apr. 19, 2016

(51) Int. Cl.
*A45B 19/06* (2006.01)
*A45B 25/18* (2006.01)
*A45B 25/02* (2006.01)
*A45B 19/04* (2006.01)

(52) U.S. Cl.
CPC ..... *A45B 19/06* (2013.01); *A45B 19/04* (2013.01); *A45B 25/02* (2013.01); *A45B 25/18* (2013.01); *A45B 2025/186* (2013.01)

(58) Field of Classification Search
CPC ..... A45B 19/04; A45B 25/02; A45B 25/18; A45B 2025/186; A45B 25/22
USPC ..... 135/15.1, 25.1, 25.33, 25.34, 26, 33.2,135/33.7
See application file for complete search history.

(56) References Cited

U.S. PATENT DOCUMENTS 1,969,821 A * 8/1934 Saxon ..... A45B 19/04 135/26
2,717,609 A * 9/1955 Zimmermaan ..... A45B 19/04 135/40
4,144,900 A 3/1979 Kinski
4,838,290 A 6/1989 Wu
D328,182 S 7/1992 Lo
5,263,505 A 11/1993 Yeom
5,398,710 A * 3/1995 Steiner ..... A45B 19/06 135/16
5,551,465 A * 9/1996 Steiner ..... A45B 19/06 135/16
5,564,453 A * 10/1996 Steiner ..... A45B 25/18 135/26
6,196,244 B1 * 3/2001 Haddad ..... A45B 25/02 135/29
6,910,490 B1 6/2005 Villa
7,121,289 B1 10/2006 Anderson
8,051,865 B1 11/2011 Uranga
2013/0333735 A1 * 12/2013 Chen ..... A45B 25/02 135/25.4
2015/0265013 A1 * 9/2015 Jenan ..... A45B 19/00 135/28

FOREIGN PATENT DOCUMENTS

CA 1068193 A1 12/1979
DE 3334057 A1 * 4/1985 ..... A45B 19/00

* cited by examiner

*Primary Examiner* — Noah Chandler Hawk
(74) *Attorney, Agent, or Firm* — Kyle A. Fletcher, Esq.

(57) ABSTRACT

The umbrella having an expandable canopy is an umbrella with a canopy of adjustable size. The umbrella having an expandable canopy is an umbrella that is further modified with a plurality of additional runners and stretchers which, when opened, are used to extend the effective diameter of the canopy to increase the protected area underneath the umbrella. The umbrella having an expandable canopy comprises a modified umbrella, a secondary canopy, a plurality of secondary stretchers, a plurality of modified ribs, a secondary runner, and a secondary top tip spring.

10 Claims, 6 Drawing Sheets

UMBRELLA HAVING AN EXPANDABLE CANOPY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

The present invention relates to the field of hand carried travelling items, more specifically, an umbrella configured with an extendable canopy.

Traditional umbrellas have the traditional structure of a primary canopy, an open cap, a top notch, a shaft, a plurality of primary stretchers, a plurality of ribs, a runner, a top spring, and an optional bottom spring. Traditional umbrellas are designed to deploy a canopy that protects an area of fixed size from rain. A shortcoming of traditional umbrellas is that if the size of the area that needs to be protected is greater than the area that can be protected by the canopy of a traditional umbrella then additional umbrellas must be deployed which requires a level of preplanning that may not be possible.

SUMMARY OF INVENTION

This shortcoming of traditional umbrellas is addressed in this disclosure.

The umbrella having an expandable canopy is an umbrella with a canopy of adjustable size. The umbrella having an expandable canopy is an umbrella that is further modified with a plurality of additional runners and stretchers which, when opened, are used to extend the effective diameter of the canopy to increase the protected area underneath the umbrella.

These together with additional objects, features and advantages of the umbrella having an expandable canopy will be readily apparent to those of ordinary skill in the art upon reading the following detailed description of the presently preferred, but nonetheless illustrative, embodiments when taken in conjunction with the accompanying drawings.

In this respect, before explaining the current embodiments of the umbrella having an expandable canopy in detail, it is to be understood that the umbrella having an expandable canopy is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the umbrella having an expandable canopy.

It is therefore important that the claims be regarded as including such equivalent construction insofar as they do not depart from the spirit and scope of the umbrella having an expandable canopy. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
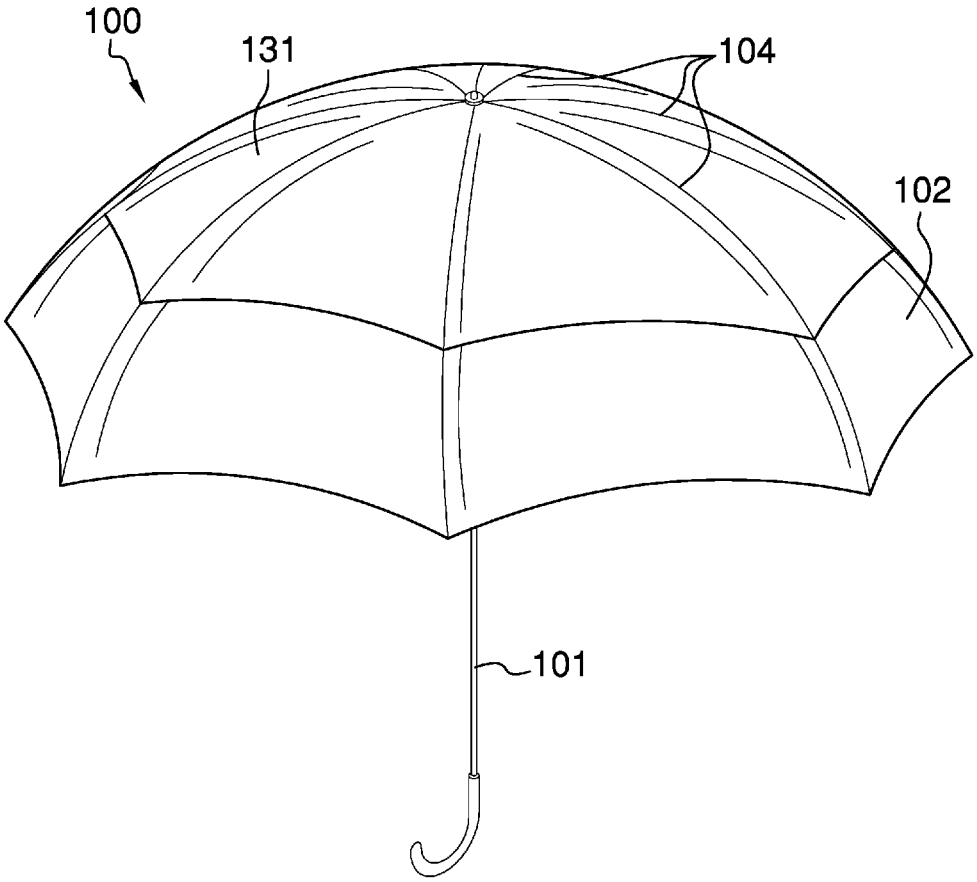
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 7.

The umbrella having an expandable canopy 100 (hereinafter invention) comprises a modified umbrella 101, a secondary canopy 102, a plurality of secondary stretchers 103, a plurality of modified ribs 104, a secondary runner 105, and a secondary top tip spring 106. The invention 100 is a modified umbrella 101 with a canopy of adjustable size. The invention 100 is a modified umbrella 101 that is further modified with the plurality of secondary stretchers 103 and a secondary runner 105 which, when opened, are used to extend the diameter of the canopy to increase the protected area underneath the invention 100.

The specification and claims of this disclosure will hereinafter implicitly assume that the modified umbrella 101 described in this invention 100 does not incorporate the bottom tip spring usually provided with a traditional umbrella. This is done for the purposes of simplicity and for clarity of exposition of the disclosure and is not intended to limit the scope of the appended claims. Those skilled in the art will recognize that the bottom tip spring of a traditional umbrella is used for securing and storing a traditional umbrella when not in use and that this assumption will not materially affect the novelty of the invention 100. Those skilled in the art will also recognize that the disclosure can be readily modified to accommodate one or more bottom springs with a minimum of modification and experimentation. For purposes of further clarity is further assumed that the key elements of a traditional umbrella comprise the primary canopy 131, the open cap 132, the top notch 133, the shaft 134, the primary runner 135, the plurality of primary stretchers 136, and the top tip spring 137.

The modified umbrella 101 is a traditional umbrella that is modified by the replacement of the original ribs with the plurality of modified ribs 104 and the addition of a secondary canopy 102, a plurality of secondary stretchers 103, a secondary runner 105, and a secondary top tip spring 106.

Figure 2:
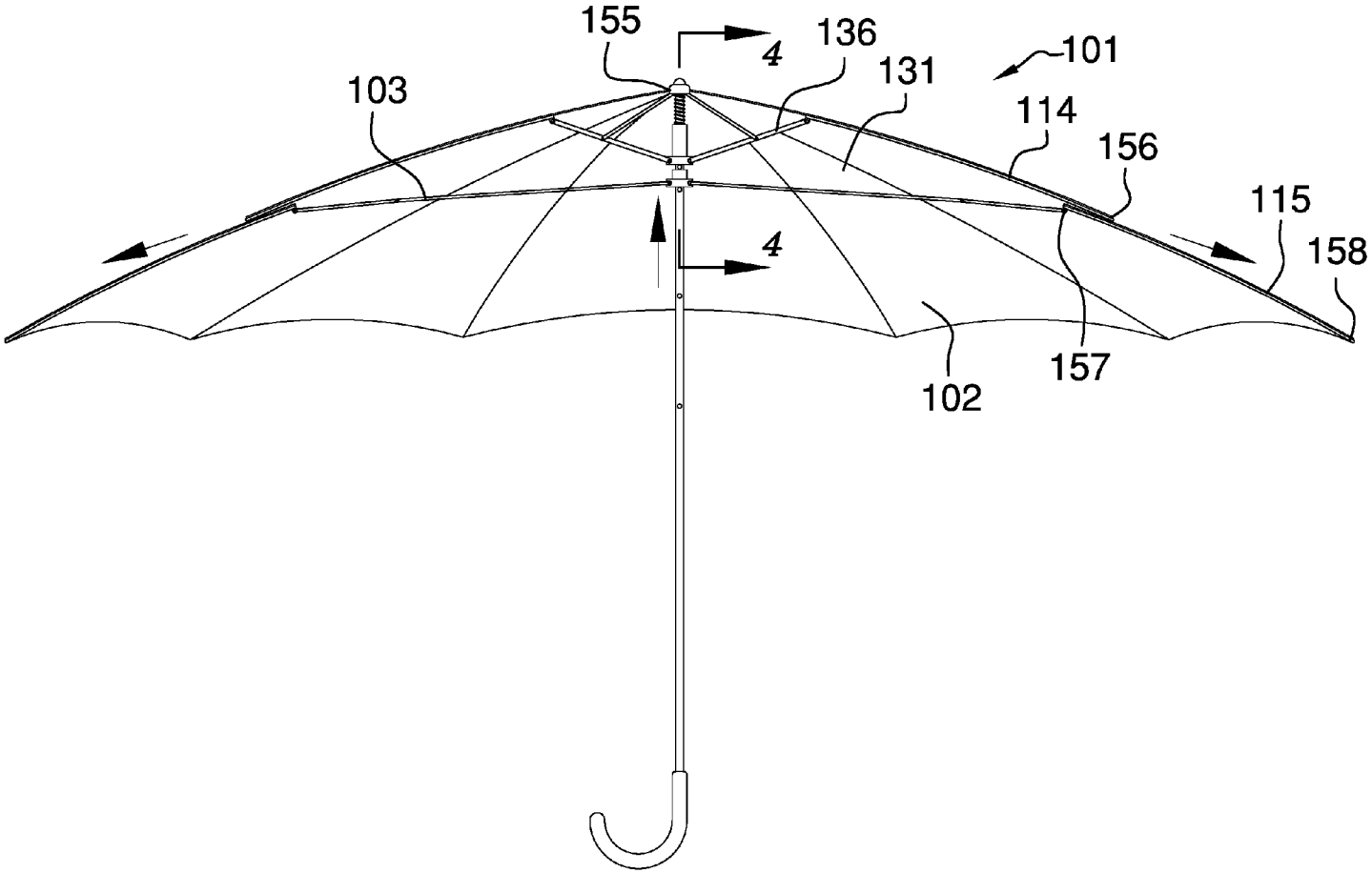
FIG. 2 is a side view of an embodiment of the disclosure.
Figure 3:
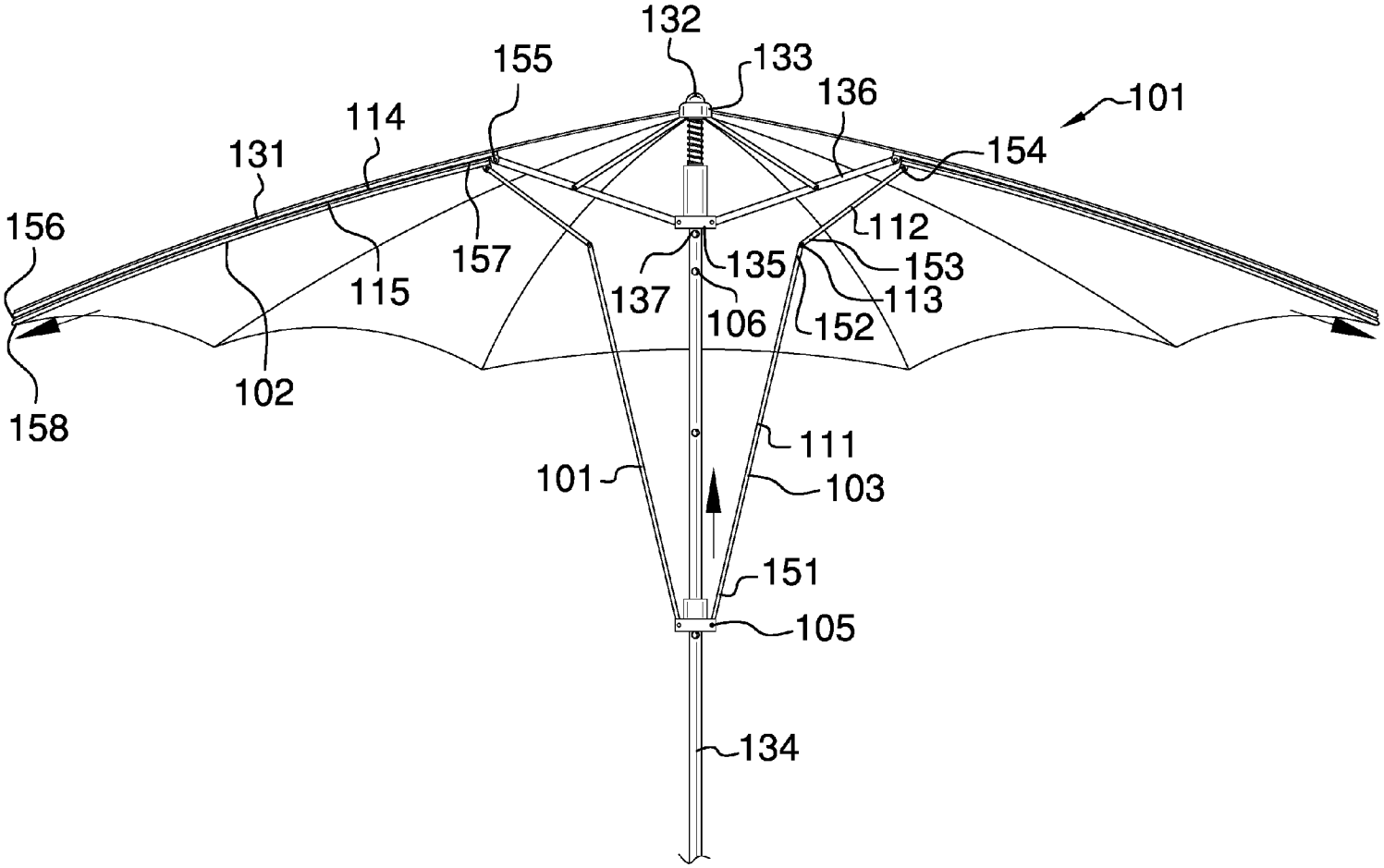
FIG. 3 is a side view of an embodiment of the disclosure.
Figure 4:
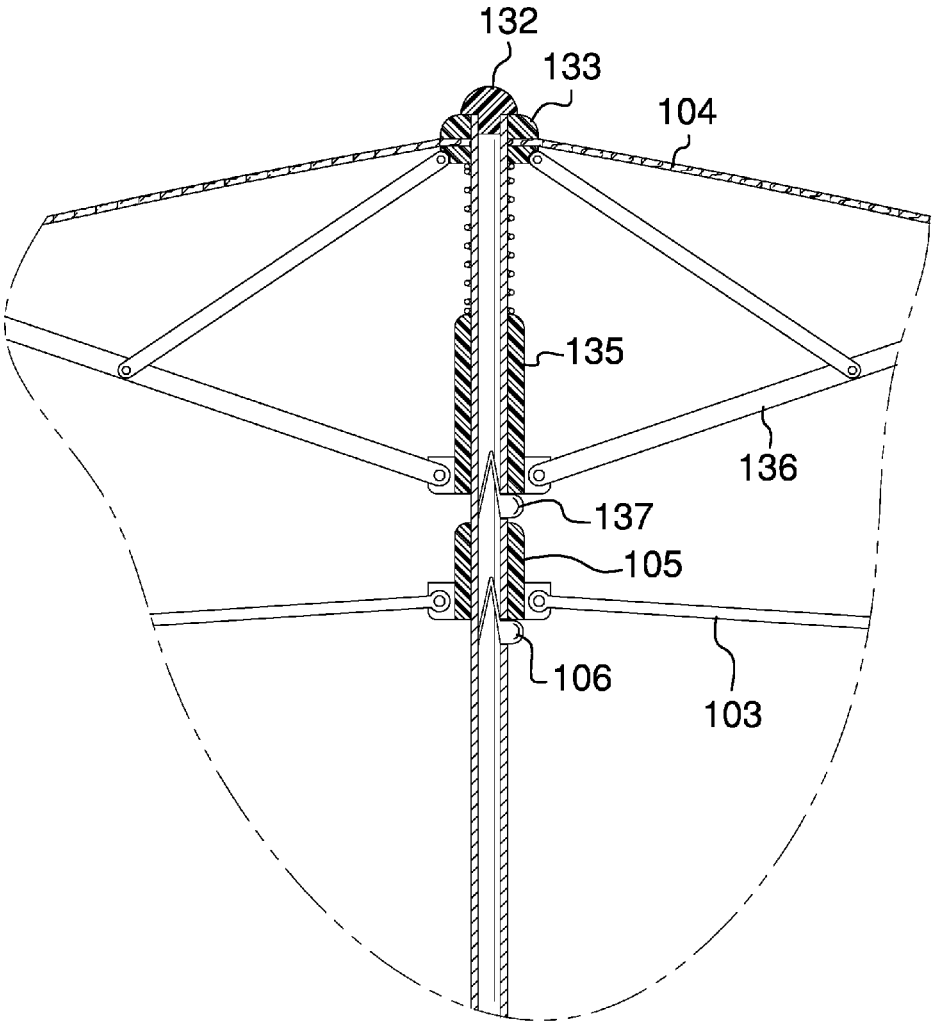
FIG. 4 is a detail view of an embodiment of the disclosure along line 4-4 in FIG. 2.
Figure 5:
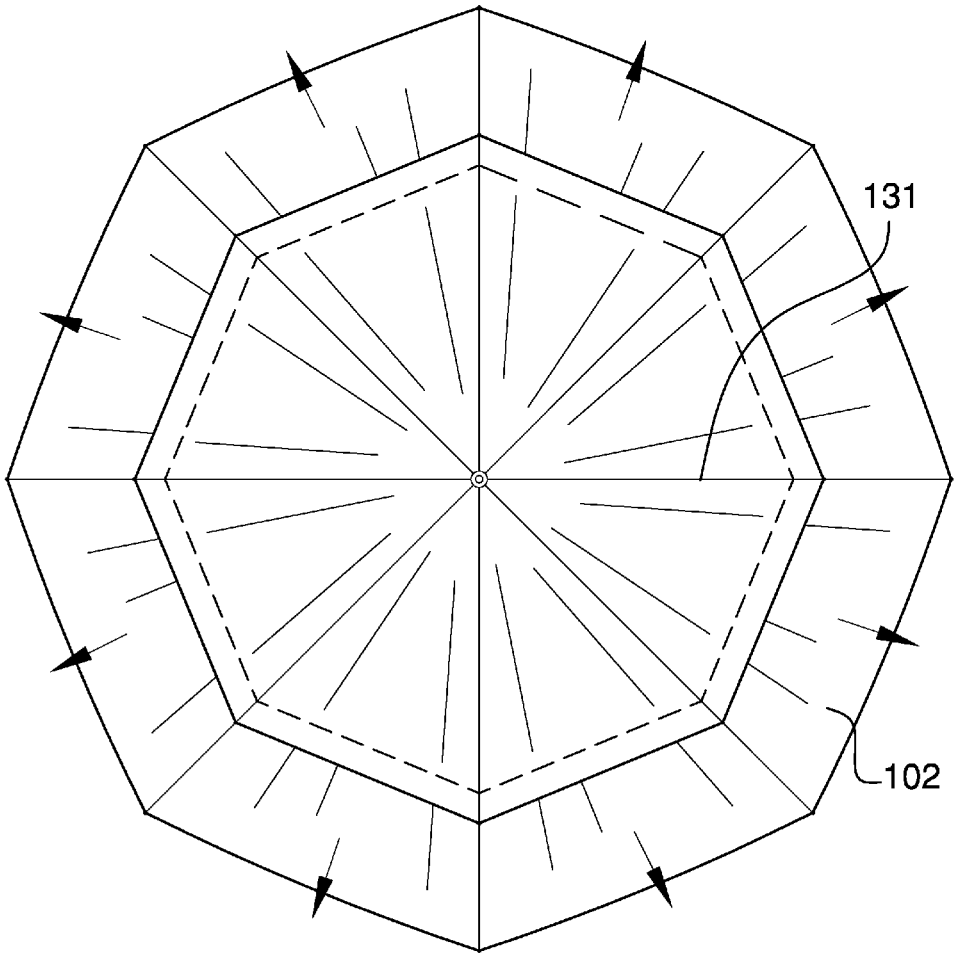
FIG. 5 is a top view of an embodiment of the disclosure.
Figure 6:
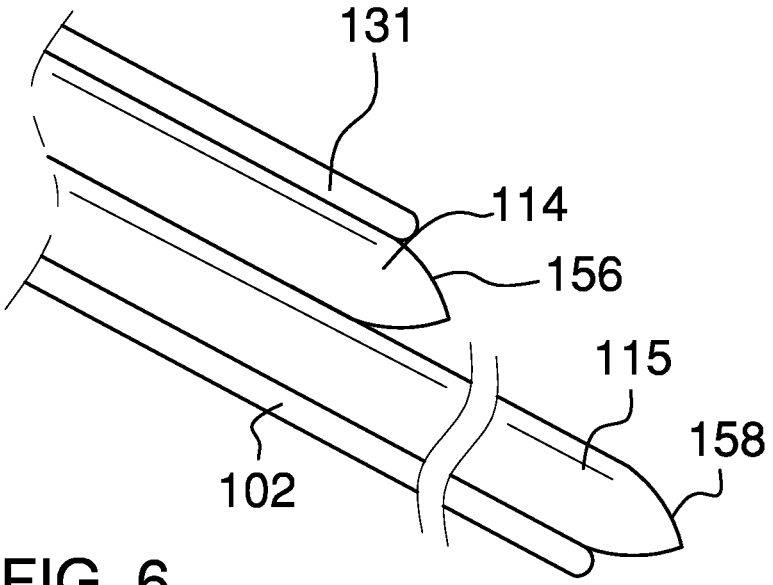
FIG. 6 is a detail view of an embodiment of the disclosure.

The secondary top tip spring 106 is built into the shaft 134 in the same manner as the top tip spring 137. As shown in FIGS. 2 and 4, the secondary top tip spring 106 is positioned on the shaft 134 relative to the top tip spring 137 such that the secondary top tip spring 106 is distal to the open cap 132 and the top notch 133. The secondary runner 105 is identical to the primary runner 135 and is positioned on the shaft 134 relative to the primary runner 135 such that the secondary runner 105 is distal to the open cap 132 and the top notch 133. The first end 151 of each of the plurality of secondary stretchers 103 are attached to the secondary runner 105. The secondary runner 105 is configured such that it will be held in place by the secondary top tip spring 106 when the secondary canopy 102 is extended. The plurality of secondary stretchers 103 and the secondary canopy 102 are discussed in greater detail elsewhere in this disclosure.

The plurality of secondary stretchers 103 are used to adjust the plurality of modified ribs 104 to extend the secondary canopy 102 beyond the edge of the primary canopy 131 thereby increasing the protected area underneath the modified umbrella 101 when the secondary canopy 102 is deployed. The plurality of modified ribs 104 and the secondary canopy 102 are discussed in more detail elsewhere in this disclosure. Each of the plurality of secondary stretchers 103 further comprises a first post 111, a second post 112, and a pivot 113. The first post 111 is a cylindrical rod that is further defined with a first end 151 and a second end 152. The second post 112 is a cylindrical rod that is further defined with a third end 153 and a fourth end 154. The first end 151 of the first post 111 is attached to the secondary runner 105 in the same manner as each of the plurality of primary stretchers 136 are attached to the secondary runner 106. The fourth end 154 of the second post 112 is attached to a rib extension 115 that is a part of each modified rib selected from the plurality of modified ribs 104.

The rib extension 115 is discussed in more detail elsewhere in this disclosure. The second end 152 and the third end 153 are connected with a pivot 113. The pivot 113 is designed to allow for the adjustment of the relative angle between the second end 152 of the first post 111 and the third end 153 of the second post 112 at two points during the operation of the modified umbrella 101. The first necessary adjustment occurs when the primary canopy 131 is raised using the primary runner 135 and the plurality of primary stretchers 136. The plurality of primary stretchers 136 will adjust the angle of the plurality of modified ribs 104 relative to the shaft 134 requiring the pivot 113 to adjust to the relative angle between the third end 153 of the second post 112 and the second end 152 of the first post 111. The second necessary adjustment occurs when the secondary runner 105 is raised to extend the secondary canopy 102.

At this point in the operation of the modified umbrella 101, the pivot 113 first acts as a linkage between the first post 111 and the second post 112 such that when the secondary runner 105 is raised the fourth end 154 of the second post 112 is forced in a direction away from the shaft 134 thereby extending the rib extension 115 for each modified rib selected from the plurality of modified ribs 104 which in turn extends the secondary canopy 102. As the rib extension 115 for each modified rib selected from the plurality of modified ribs 104 is extended, the pivot 113 accommodates the readjustment of the relative angle between the third end 153 of the second post 112 and the second end 152 of the first post 111.

The plurality of modified ribs 104 is a structure that is used to support and extend the primary canopy 131 to provide for a protected area in periods or rain and to support and to extend the secondary canopy 102 in order to expand the protected area in periods of rain. The primary canopy 131 and the secondary canopy 102 are attached to the plurality of modified ribs 104. Each of the plurality of modified ribs 104 comprises a rib 114 and a rib extension 115. The rib 114 is a rectangular rod that further comprises a fifth end 155 and a sixth end 156. The rib extension 115 further comprises a seventh end 157 and an eighth end 158. The fifth end 155 of the rib 114 is attached to the top notch 133 in a manner that allows for the rotation of the rib 114. The sixth end 156 of the rib 114 is attached to the primary canopy 131.

Figure 7:
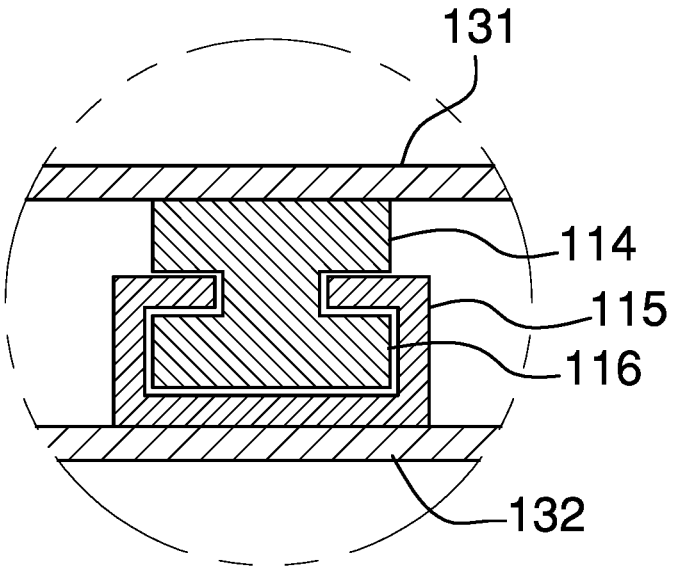
FIG. 7 is a detail view of an embodiment of the disclosure.

As shown in FIG. 7, the rib extension 115 is a rectangular rod that is attached to the rib 114 using a tongue and groove arrangement 116. The tongue and groove arrangement 116 allows the rib extension 115 to slide freely along the axis of the rib 114. The fourth end 154 of the second post 112 is attached to the seventh end 157 of the rib extension 115. The eighth end 158 of the rib extension 115 is positioned such that it is the end of the rib extension 115 that is distal from the top notch 133. As shown most clearly in FIGS. 5, 6, and 7, the secondary canopy 102 is a ring of material that is formed from the same material as the primary canopy 131. The secondary canopy 102 is attached to the side of the rib extensions 115 that is distal from the primary canopy 131.

To use the invention 100, the modified umbrella 101 is opened as traditional umbrella would be. The motion of the primary runner 135 and the plurality of primary stretchers 136 will draw the secondary runner 105 up the shaft 134. To extend the secondary canopy 102, the secondary runner 105 is raised up the shaft 134 until the secondary runner 105 is locked into position by the secondary top tip spring 106. The motion each of the plurality of secondary stretchers 103 pushes out the rib extension 115 of each of the plurality of modified ribs 104 thereby extending the secondary canopy 102. When the secondary canopy is retracted 102, a natural draping of the secondary canopy 102, which will be hidden from view when the invention 100 is completely closed.

The following definitions were used in this disclosure:

Bottom Tip Spring: As used in this disclosure, a bottom tip spring is a component of an umbrella that is used to hold the runner is a position that retracts the canopy of the umbrella. A typical bottom tip spring arrangement comprises a triangular piece of metal attached to a spring that pushes the triangular piece of metal away from the shaft. The triangular piece of metal is positioned to allow the runner to pass over the bottom tip spring in one direction only. To move the runner in the opposite direction requires that the triangular piece of metal be pushed towards the shaft. Typically, an umbrella is fitted with a bottom tip spring and a top tip spring.

Pivot: As used in this disclosure, a pivot is a rod or shaft around which an object rotates or swings.

Runner: As used in this disclosure, a runner is a component of an umbrella that fits over the center post of the umbrella. Stretchers are used to connect the ribs of the umbrella to the runner, which in turn connects the runner to the center post. By raising the runner, the stretchers expand the ribs to create a structure upon which the canopy of the umbrella is placed.

Top Tip Spring: As used in this disclosure, a top spring is a component of an umbrella that is used to hold the runner is a position that extends the canopy of the umbrella. A typical top spring arrangement comprises a triangular piece of metal attached to a spring that pushes the triangular piece of metal away from the shaft. The triangular piece of metal is positioned to allow the runner to pass over the top tip spring in one direction only. To move the runner in the opposite direction requires that the triangular piece of metal be pushed towards the shaft. Typically, an umbrella is fitted with a bottom tip spring and a top tip spring.

Umbrella: As used in this disclosure, an umbrella is a device used for protection against the weather comprising a circular canopy made of a textile or sheeting that is mounted on a folding metal frame that is supported by a central rod.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A rain protection device comprising:

a modified umbrella, a secondary canopy, a plurality of secondary stretchers, a plurality of modified ribs, a secondary runner, and a secondary top tip spring;

wherein the secondary canopy is adjustable in size;

wherein the secondary top tip spring is built into the shaft;

wherein the secondary top tip spring is positioned on the shaft relative to a top tip spring such that the secondary top tip spring is distal to an open cap and a top notch;

wherein the secondary runner is identical to a primary runner and is positioned on the shaft relative to the primary runner such that the secondary runner is distal to the open cap and the top notch;

wherein the secondary runner is configured such that it will be held in place by the secondary top tip spring when the secondary canopy is extended;

wherein each of the plurality of secondary stretchers further comprises a first post, a second post, and a pivot;

wherein the first post is further defined with a first end and a second end;

wherein the second post is further defined with a third end and a fourth end;

wherein the first end of the first post is attached to the secondary runner;

wherein the fourth end of the second post is attached to a rib extension;

wherein the second end and the third end are connected with the pivot;

wherein the pivot is designed to allow for the adjustment of the relative angle between the first post and the second post.

2. The rain protection device according to claim 1 wherein the plurality of modified ribs is a structure that supports and extends the modified umbrella;

wherein the plurality of modified ribs is a structure that supports and extends the secondary canopy.

3. The rain protection device according to claim 2 wherein the primary canopy is attached to the plurality of modified ribs;

wherein the secondary canopy is attached to the plurality of modified ribs.

4. The rain protection device according to claim 3 wherein each of the plurality of modified ribs comprises a rib and the rib extension;

wherein the rib is further defined by a fifth end and a sixth end;

wherein the rib extension is further defined by a seventh end and an eighth end.

5. The rain protection device according to claim 4 wherein the fifth end of the rib is attached to the top notch in a manner that allows for the rotation of the rib.

6. The rain protection device according to claim 5 wherein the sixth end of the rib is attached to the primary canopy.

7. The rain protection device according to claim 6 wherein the rib extension is attached to the rib using a tongue and groove arrangement.

8. The rain protection device according to claim 7 wherein the fourth end of the second post is attached to the seventh end of the rib extension.

9. The rain protection device according to claim 8 wherein the secondary canopy is a ring of material.

10. The rain protection device according to claim 9 wherein the secondary canopy is attached to the side of the rib extension that is distal from the primary canopy.

* * * * *